US010999681B2

(12) United States Patent
Starnes et al.

(10) Patent No.: US 10,999,681 B2
(45) Date of Patent: May 4, 2021

(54) MOVING MAGNET ACTUATOR WITH COIL FOR PANEL AUDIO LOUDSPEAKERS

(71) Applicant: Google LLC, Mountain View, CA (US)

(72) Inventors: Mark William Starnes, Sunnyvale, CA (US); James East, San Jose, CA (US)

(73) Assignee: Google LLC, Mountain View, CA (US)

( * ) Notice: Subject to any disclaimer, the term of this patent is extended or adjusted under 35 U.S.C. 154(b) by 56 days.

(21) Appl. No.: 16/355,646

(22) Filed: Mar. 15, 2019

(65) Prior Publication Data

US 2020/0296515 A1 Sep. 17, 2020

(51) Int. Cl.

| | |
|---|---|
| ***H04R 9/04*** | (2006.01) |
| ***H04R 9/06*** | (2006.01) |
| ***H04R 1/02*** | (2006.01) |
| ***H04R 7/04*** | (2006.01) |
| ***H04R 9/02*** | (2006.01) |

(52) U.S. Cl.

CPC ..... *H04R 9/06* (2013.01); *H04R 1/025* (2013.01); *H04R 7/04* (2013.01); *H04R 9/025* (2013.01); *H04R 9/04* (2013.01); *H04R 2499/11* (2013.01)

(58) Field of Classification Search

CPC . H04R 7/04; H04R 9/02; H04R 9/025; H04R 9/04; H04R 9/041; H04R 9/045; H04R 9/046; H04R 9/047

USPC ..... 381/400, 403, 405, 407, 408, 409, 410, 381/412, 420, 431

See application file for complete search history.

(56) References Cited

U.S. PATENT DOCUMENTS

| | | | | |
|---|---|---|---|---|
| 7,492,918 | B2 | 2/2009 | Stiles et al. | |
| 10,194,249 | B2 | 1/2019 | Choisel et al. | |
| 10,216,231 | B1 | 2/2019 | Landick | |
| 2002/0067843 | A1* | 6/2002 | Abe | H04R 9/022 381/407 |
| 2005/0180592 | A1* | 8/2005 | Miura | H04R 9/10 381/401 |
| 2007/0025586 | A1 | 2/2007 | Young | |
| 2008/0317276 | A1* | 12/2008 | Sorensen | H04R 9/063 381/401 |
| 2017/0223463 | A1 | 8/2017 | Salvatti | |

FOREIGN PATENT DOCUMENTS

JP 2007-005845 1/2007

OTHER PUBLICATIONS

Machine Translation of Fujimoto Japanese Publication No. JP2007-5845 (Year: 2007).*

PCT International Search Report and Written Opinion in International Appln. No. PCT/US2019/063046, dated Feb. 13, 2020, 15 pages.

* cited by examiner

*Primary Examiner* — Katherine A Faley

(74) *Attorney, Agent, or Firm* — Fish & Richardson P.C.

(57) ABSTRACT

A panel audio loudspeaker includes a panel and an actuator rigidly coupled to a surface of the panel. The actuator includes: a magnet assembly that includes a permanent magnet arranged within a cup, wherein an air gap exists between sidewalls of the cup and the permanent magnet; and a coil rigidly coupled to the panel, the coil including a length of an electrically conducing wire wound in a coil and extending along an axis. The coil includes a first region having a first winding density and a second region having a second winding density higher than the first winding density, the second region at least partially extending into the air gap of the magnet assembly.

27 Claims, 4 Drawing Sheets

MOVING MAGNET ACTUATOR WITH COIL FOR PANEL AUDIO LOUDSPEAKERS

FIELD

This disclosure relates generally to moving magnet actuators, particularly, to actuators for panel audio loudspeakers.

BACKGROUND

Many conventional loudspeakers produce sound by inducing piston-like motion in a diaphragm. Panel audio loudspeakers, such as distributed mode loudspeakers (DMLs), in contrast, operate by inducing uniformly distributed vibration modes in a panel through an electro-acoustic actuator. Typically, the actuators are moving magnet actuators or piezoelectric actuators.

Conventional panel audio loudspeaker magnet systems can have performance limitations arising from the soft magnetic material increasing inductance and electrical impedance with increasing frequency. This increase in electrical inductance can have drawbacks, including a reduction in the acoustic output at high frequency.

The temperature and electrical resistance of a coil conductor in a moving magnet actuator also tends to increase with increasing current that can cause power compression and limit the maximum force generated by the actuator. It may therefore be necessary to maximize the efficiency of the force generated by the actuator.

SUMMARY

In general, in one aspect, the disclosure features panel audio loudspeakers that include a panel and an actuator rigidly coupled to a surface of the panel. The actuator includes: a magnet assembly that includes a permanent magnet arranged within a cup, wherein an air gap exists between sidewalls of the cup and the permanent magnet; and a coil rigidly coupled to the panel, the coil including a length of an electrically conducing wire wound in a coil and extending along an axis. The coil includes a first region having a first winding density and a second region having a second winding density higher than the first winding density, the second region at least partially extending into the air gap of the magnet assembly.

Embodiments of the panel audio loudspeaker can include one or more of the following features. For example, the first region can extend in the axial direction from a first end of the coil coupled to the panel to the magnet assembly. The second region can extend in the axial direction in the air gap to a second end of the coil opposite the first end of the coil.

The first region can have a winding density lower compared to an average winding density of the coil and the second region has winding density higher than the average winding density. The first region can have a minimum winding density that is 75% of or less than to the average winding density (e.g., 60% or less, 50% or less, 40% or less, 30% or less, 20% or less). The second region can have a maximum winding density that is 125% of or more than to the average winding density (e.g., 140% or more, 150% or more, 160% or more, 170% or more, 180% or more, 190% or more, 200% or more).

A winding density of the coil in the first region and/or second region can be substantially constant along the axial direction. Alternatively, the winding density of the coil in the first region and/or second region can vary along the axial direction.

The coil can have a greater mechanical compliance in the first region than the second region. The first and second regions can be configured so that the panel audio loudspeaker includes a resonant mode at a frequency in a range from 5 kHz to 20 kHz that is not present in a comparable panel audio loudspeaker having a coil with a uniform coil winding density.

The actuator can include a cap extending along the coil adjacent to the first region of the coil, the cap being bonded the same surface as an end of the coil. The cap can be a kapton or aluminum cap. A radial thickness of the cap and the first region of the coil can be the same as or less than a radial thickness of the second region of the coil. The cap can be positioned at an outer circumference of the coil.

The magnet assembly can be suspended from the panel by one or more compliant members. The magnet assembly can include a pole piece, the permanent magnet being positioned in an axial direction between the pole piece and a back plate of the cup, the air gap extending adjacent the pole piece. The second region of the coil can be adjacent the pole piece in the axial direction. The pole piece can include a soft magnetic material. The sidewalls of the cup can include a portion comprising a permanent magnet material and a portion comprising a soft magnetic material.

The actuator can include a plate between the coil and the panel, the plate being bonded on one side to the panel and on an opposite side to the coil.

The panel can include a display panel, such as an OLED display panel.

In general, in another aspect, the invention features a mobile device or a wearable device that includes: a housing; a display panel mounted in the housing; an actuator coupling plate attached to the display panel; a coil attached to the actuator coupling plate, the coil defining an axis and having a first region and a second region, the first region having a lower density of windings compared to the second region; and a magnet assembly including an inner portion and an outer portion separated from the inner portion by an air gap, the inner portion including a permanent magnet extending within the magnet assembly along the axial direction, wherein the coil is arranged so that the second region is in the air gap. The mobile device or wearable device also includes an electronic control module electrically coupled to the coil and programmed to energize the coil to cause axial motion of the magnet assembly relative to the coil such that the display panel vibrates at frequencies and amplitudes sufficient to produce an audio response from the display panel.

Embodiments of the mobile device or wearable device can include one or more features of the prior aspect.

Among other advantages, the disclosure features actuators for panel audio loudspeakers that provide improved efficiency compared to conventional actuators. For example, by actuators that include coils having higher winding densities in areas where the system's magnetic field is focused can provide a higher force at the same voltage compared to coils with constant winding densities.

Actuators with improved robustness are disclosed. For example, improved drop test performance for drops out of the movement plane of the actuator can be achieved by providing a more resilient connection of the coil to the actuator frame. Such connections can be provided, without increasing the volume of the coil, by having a low winding density region at the point where the coil connects to the frame and including a cap at this position. The cap can be used to improve the mechanical strength of the bond between the coil and the frame.

Furthermore, actuators with improved frequency response are disclosed. For instance, coils with regions of reduced winding density can be tailored to provide an additional resonance of the resulting mass-spring system, which can be tuned to improve the response at certain audio frequencies.

This technology applies to panel audio systems designed to provide acoustic and/or haptic feedback. The panel may be a display system, for example based on OLED technology. The panel may be part of a smartphone or wearable devices.

Other advantages will be evidence from the description, drawings, and claims.

DETAILED DESCRIPTION

Figure 1:
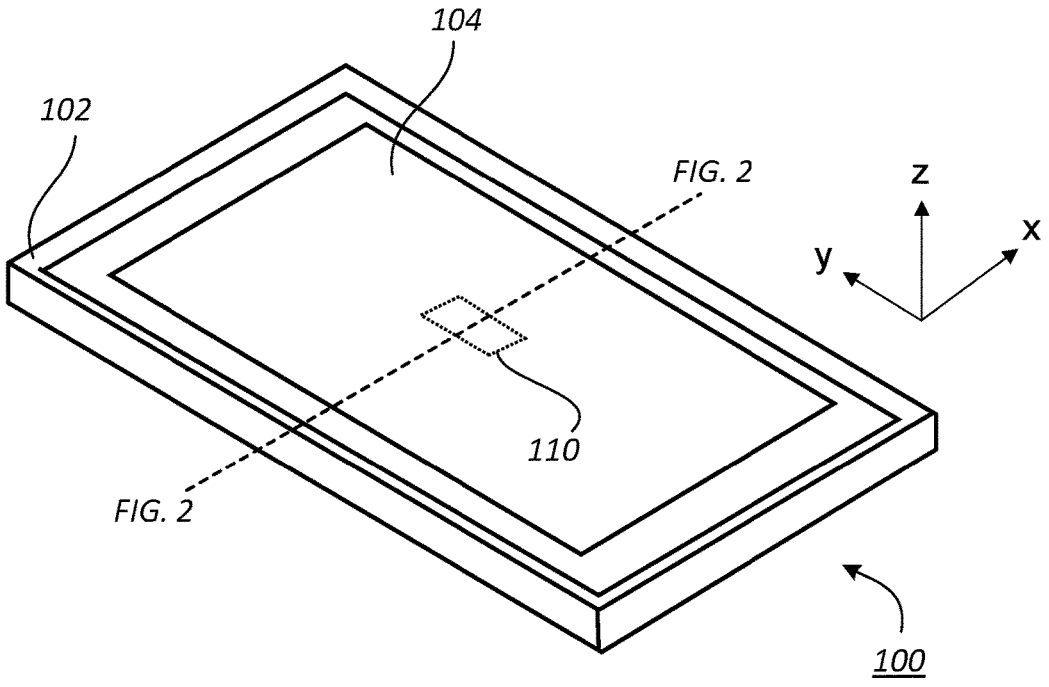
FIG. 1 is a perspective view of a mobile device that features a panel audio loudspeaker.

Referring to FIG. 1, a mobile device 100 includes a device chassis 102 and a touch display panel 104 including a flat panel display (e.g., an OLED or LCD display panel) that integrates a panel audio loudspeaker composed of display panel 104 and an actuator 110 mechanically coupled to the back surface of panel 104. Mobile device (e.g., a smartphone) 100 interfaces with a user in a variety of ways, including by displaying images, receiving touch input via a touch panel display 104, and producing audio and haptic output. Generally, as part of a panel audio loudspeaker, the vibrating panel generates human-audible sound waves, e.g., in the range of 20 Hz to 20 kHz. In addition to producing sound output, mobile device 100 can also produces haptic output via display panel 104. For example, the haptic output can correspond to vibrations in the range of 150 Hz to 300 Hz.

Typically, a mobile device like mobile device 100 has a depth (along the z-axis) of approximately 10 mm or less, a width (along the x-axis) of 60 mm to 80 mm (e.g., 68 mm to 72 mm), and a height (along the y-axis) of 100 mm to 160 mm (e.g., 138 mm to 144 mm). Accordingly, compact and efficient actuators for driving panel 504, such as those described above, are desirable.

Figure 2:
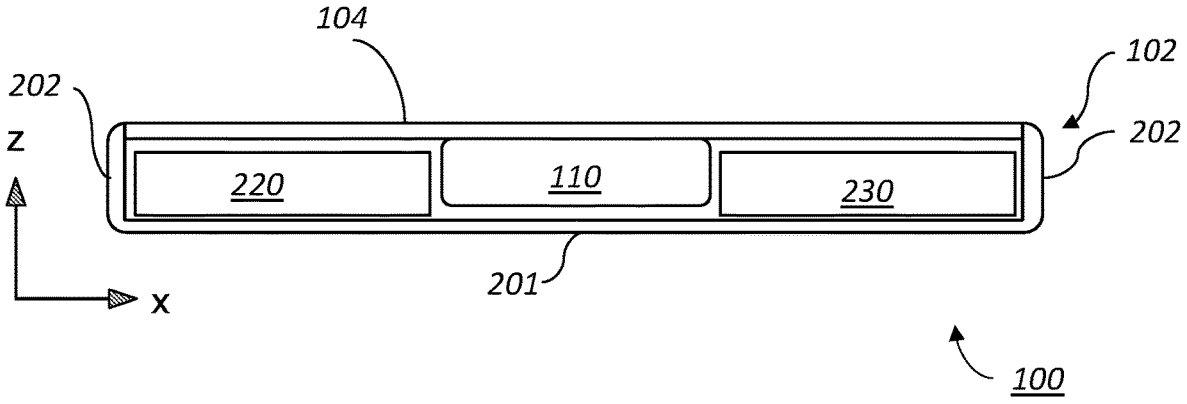
FIG. 2 is a cross-sectional view schematic view of the mobile device shown in FIG. 1.

Referring to FIG. 2, which shows a cross-section through mobile device 100, together device chassis 102 (having back plate 201 and side walls 202) and display panel 104 form an enclosure for housing components of mobile device 100 including actuator 110, a battery 230 and an electronic control module 220.

Embodiments of actuator 110 are described below. Generally, actuator 110 is sized to fit within a volume constrained by other components housed in mobile device 100, including electronic control module 220 and battery 230. Electronic control module 220 provides control signals to actuator 110, causing it to produce audio and/or haptic output.

Figure 3:
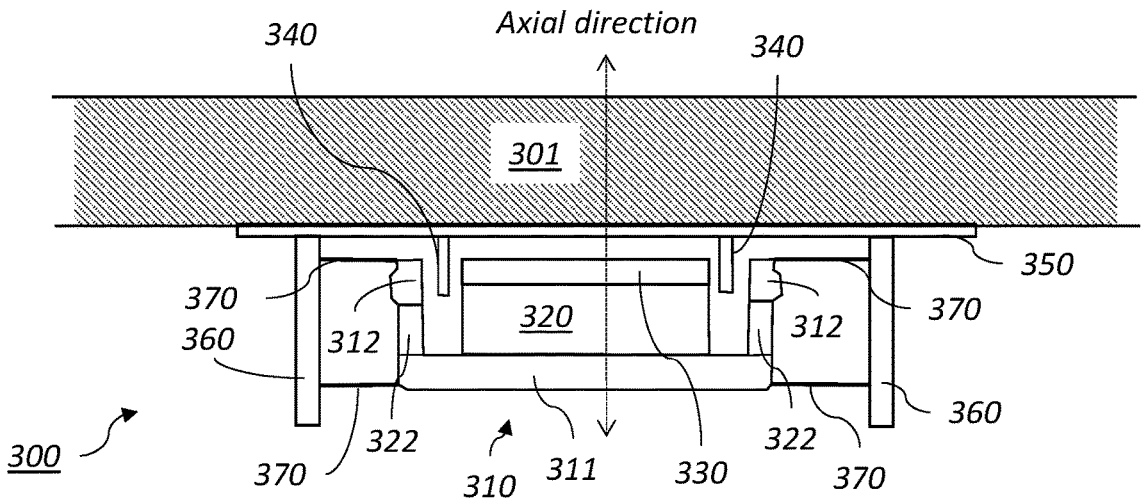
FIG. 3 is a cross-sectional view of an embodiment of a moving magnet actuator in a panel audio loudspeaker.

Referring to FIG. 3, an exemplary moving magnet actuator suitable for use in mobile device 100 is actuator 300, which includes a permanent magnet 320 shaped as a thin disc and a coil 340. Coil 340 includes coil windings wound in a coil and connected to an actuator coupling plate 350 which, when fully assembled, is attached to a panel 301 of the panel audio loudspeaker. The magnet 320 is housed in a cup 310 composed of a soft magnetic back plate 311 (e.g., a ferrous plate) and side walls composed of a magnetic portion 322 and a soft magnetic caps 312. Magnet 320 is sandwiched between base 311 of the cup 310 and a soft magnetic top plate 330, or pole piece. Cup 310 is attached, via spring elements 370, to a frame 360, which is attached to actuator coupling plate 150. Spring elements 370 suspend cup 310, magnet 320 and top plate 330 relative to coil 340. An air gap exists between the side walls of cup 310 and magnet 320 and top plate 330. Coil 340 is positioned in the air gap.

Generally, components of actuator 300 including coil 340, magnet 320, and cup 310 can be continuously rotationally symmetric about the axis (i.e., cylindrical in shape) or can have discrete or no rotational symmetry about the axis. For example, actuator components with discrete rotational symmetry can have a square, rectangular, or other polygon-shaped footprint in the plane orthogonal to the axis. Such shapes can have sharp, beveled, or filleted corners.

The actuator shown in FIG. 3 can be compact. For example, the thickness of the actuator in the axial direction can be on the order of a few mm, e.g., 10 mm or less, 8 mm or less, 5 mm or less, 4 mm or less, 3 mm or less, 2 mm or less. Accordingly, in certain embodiments, coil 340 can have an axial length of about 2-6 mm, where approximately half its length sits in the air gap of the magnet assembly and approximately half stands proud of the air gap. The lateral dimensions of actuator 300 can also be relatively small. For example, the outer axially magnetized magnet can have a lateral diameter (i.e., the diameter orthogonal to the symmetry axis) of 20 mm or less (e.g., 15 mm or less, 12 mm or less, 10 mm or less, 8 mm or less, 7 mm or less, 6 mm or less, 5 mm or less).

In general, the magnets can be formed from a material than can be permanently magnetized, such as rare earth magnet materials. Exemplary materials include neodymium iron boron, samarium cobalt, barium ferrite, and strontium ferrite.

The soft magnetic pole piece and cup portions of the cup can be formed from a material or materials that are readily magnetized in the presence of an external magnetic field and demagnetized when the external field is removed. Typically, such materials have high magnetic permeability. Examples include high carbon steel and vanadium permendur. Accordingly, the soft magnetic plate and yoke serve to guide the magnetic flux lines from the axially magnetized magnets across the air gap.

Magnet 320 is typically axially magnetized. In other words, the poles of the permanent magnet are aligned along the axial direction. When the coil is energized, it generates a magnetic field that interacts with the field of the permanent magnet, axially displacing the magnetic cup, magnet, and top plate relative to the coil. Magnet 322 can be axially or radially magnetized, for example.

Figure 4:
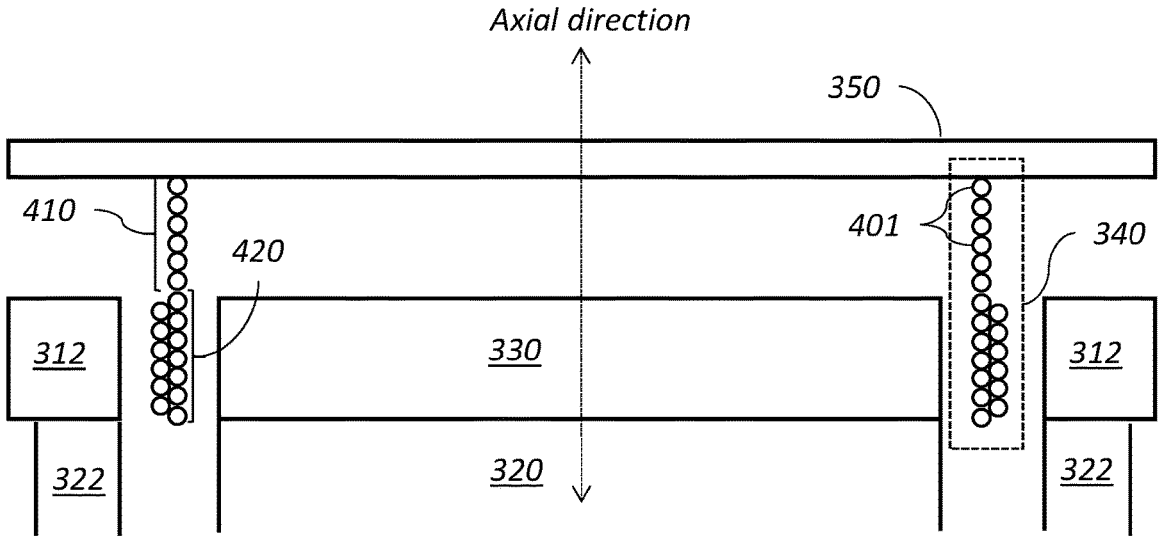
FIG. 4 is a cross-sectional view of a portion of an embodiment of a moving magnet actuator showing details of the actuator's coil.

Referring to FIG. 4, coil 340 is composed of a length of electrically-conducting wire (e.g., copper wire) spirally wound to form a spring. As depicted in cross-section, individual windings 401 are arranged side-by-side, but generally, each winding extends a small distance in the axial direction so that the subsequent winding is axially displaced from the prior one. The wire has sufficient mechanical stiffness so that the coil can be self-supported (e.g., it need not include a former or other support to maintain its shape). Coil 340 is attached to a surface of plate 350, e.g., using an adhesive, at one end. Electrical leads to and from the coil can be attached to the surface plate 350, allowing electrical access to the coil.

Coil 340 is composed of two regions having different winding densities. The winding density refers to the number of turns of the coil per unit distance. A first region 410, which corresponds to the portion of the coil extended between the air gap and plate 350, is a low winding density region, while region 420, which extends into the air gap, is a high winding density region. Here, "high" and "low" density are relative to an average winding density of the coil, which is the total number of windings divided by the length of the coil. While the first region 410 is depicted as being composed of a single layer of windings and the second region 420 is depicted as being composed of a double layer of windings, in general, either region can have a single or multiple winding layers. Moreover, adjacent windings need not be arranged touching side-by-side as depicted. More generally, coils can include adjacent windings that are stacked on each other and/or spaced apart from each other.

In general, the relative winding density of the first and second regions can vary depending on the magnetic field strength and corresponding current load needed to drive the actuator. In some embodiments, first region 410 can have a minimum winding density that is 75% or less compared to the average winding density (e.g., 60% or less, 50% or less, 40% or less, 30% or less, 20% or less). In certain embodiments, second region 420 can have a maximum winding density that is 125% or more compared to the average winding density (e.g., 140% or more, 150% or more, 160% or more, 170% or more, 180% or more, 190% or more, 200% or more).

Generally, the relative axial length of region 410 and region 420 can vary. As depicted in FIG. 4, these regions can have axial lengths that are approximately equal. Alternatively, region 410 can be longer or shorter than region 420, depending on the design of the actuator. In some embodiments, each region has an axial length in a range from about 0.5 mm to about 3 mm.

Without wishing to be bound by theory, it is believed that by using a coil with a higher winding density in regions where the magnetic field from the magnet assembly is focused (e.g., within the air gap), it is possible to get a larger shove (i.e., force) from the actuator, compared to a coil where the winding density is uniform. Here, the "shove" refers to the value $Bl^2/R$, where B is the magnetic field strength from the magnet assembly at the coil, l is the length of coiled wire in the magnetic field, and R is the resistance of the coil. Accordingly, by using a coil with a high winding density in a region where the magnetic field is focused, and a low winding density where it isn't, Bl is maintained while R is reduced compared to a coil having uniform, high winding density. The result is a larger shove compared to the coil with uniform winding density.

Furthermore with an appropriate distribution of windings, the low winding density region creates an extra resonant mode when bonded to the panel. The mode is the result of the coupled oscillator that results from increased compliance of the coil in the region of the panel. Specifically, the coupled oscillator is formed from the mass of the coil in the high winding density region and the mass of the panel, coupled by the more-compliant "spring-like" low winding density region.

The frequency of this resonance can be tuned to be in the audio band (e.g., 5 kHz-20 kHz), creating increased high-frequency output. Generally, the precise frequency of this resonance can be tuned by appropriately selecting the stiffness of the spring provided by the low winding density region and the mass of the high winding density region. Tuning can be performed empirically, either by simulation of the oscillator or physical experiments, or both. In some embodiments, the system can be designed to provide a resonance in a range from 8 kHz-10 kHz, 10 kHz-12 kHz, 12 kHz-15 kHz, or 15 kHz-20 kHz, for example.

The coil compliance of the low winding density region in the plane normal to its axis can result in increased deformation of the coil under drop impact from the side, for example, reducing the likelihood that the bond to the panel will shear off. Accordingly, inclusion of a low winding density region can increase the mechanical robustness of the actuator.

While the foregoing actuator features a coil that is free standing (e.g., unsupported by other structures, such as a former), other implementations are possible. For example, referring to FIG. 5, in some embodiments, the low winding density region 410 of coil 340 can be supported by a cap 510. Cap 510 is a cylindrical element attached to or integrated into plate 350 that provides mechanical support for the low winding density region 410 of coil 340. Cap 510 can be formed from a material having a higher rigidity than the region 410 of the coil. In some embodiments, cap 510 is formed from kapton (or other polymer) or aluminum (or other metal), for example.

Figure 5:
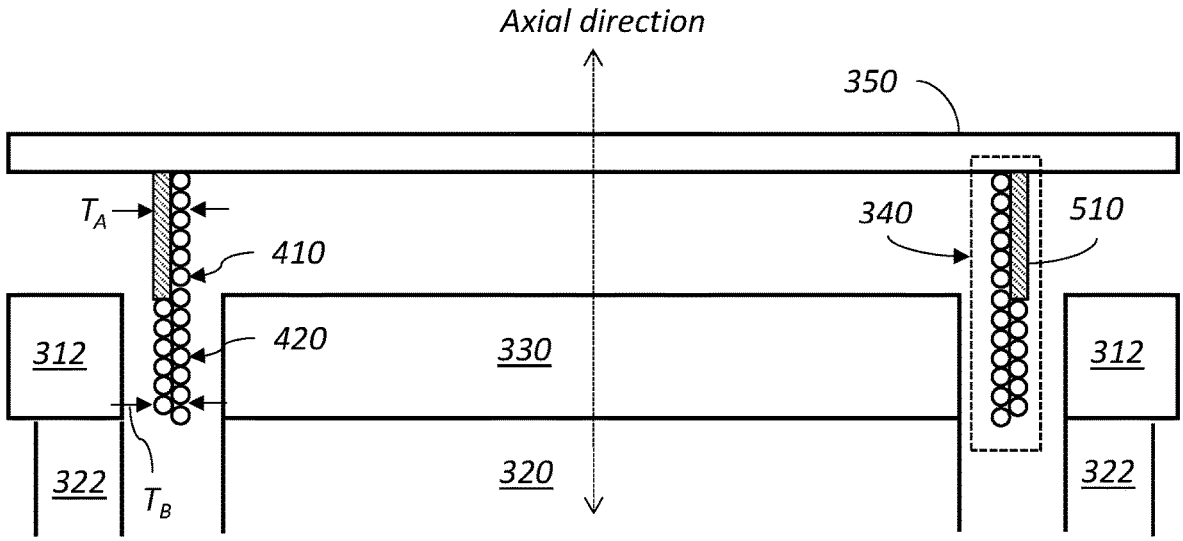
FIG. 5 is a cross-sectional view of a portion of another embodiment of a moving magnet actuator showing details of the actuator's coil.

The form factor of the coil means a cap can be placed over the end of the coil and extending along the sides where the coil is thin, making for a good bond to the cap and a reliable means of attaching the coil to the panel audio object. In FIG. 5, the radial thickness of the combined low winding density region 410 and cap 510 is shown as $T_A$, and the radial thickness of the high winding density region 420 is shown as $T_B$. As depicted, $T_A=T_B$, however $T_A$ and $T_B$ can be different. Generally, where $T_A$ is less than or equal to $T_B$, the additional rigidity provided by cap 510 can be achieved without increasing the overall width of the coil compared to the coil thickness in the high winding density region 420.

While cap 510 is shown as a having a wall with a uniform thickness along its axial length, other form factors are possible. For example, in some embodiments, a cap can include a flange to provide a larger surface area at one end for bonding to plate 350.

Figure 6:
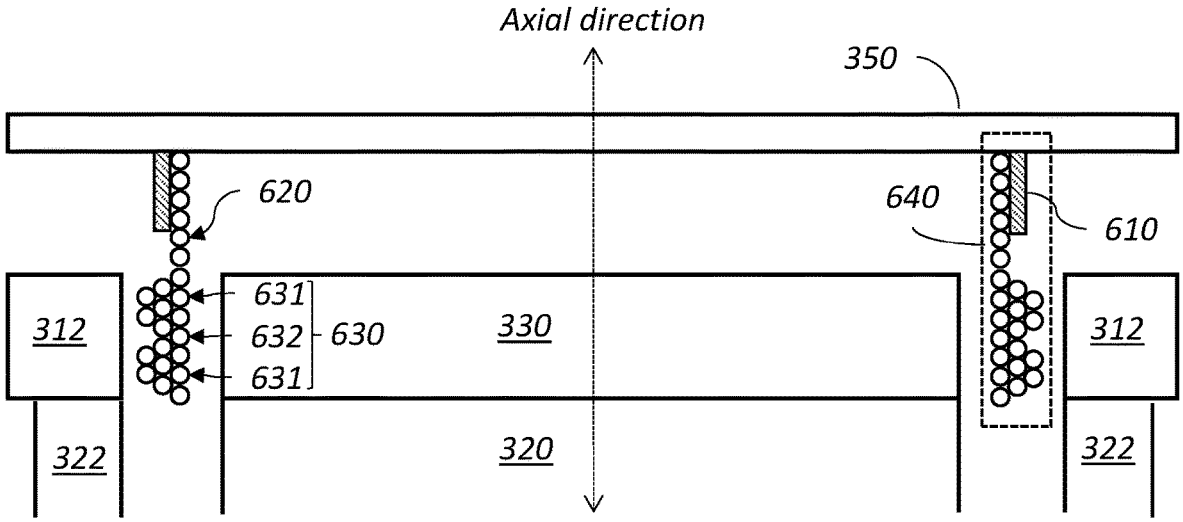
FIG. 6 is a cross-sectional view of a portion of yet another a moving magnet actuator showing details of the actuator's coil.

Other variants are also possible. For example, referring to FIG. 6, in some embodiments a coil 640 includes a cap 610 that is only partially co-extensive with a low winding density region 620 of the coil. In addition, the high winding density region can include sub-regions of differing winding density. For example, region 630 features sub-regions 631 that having higher winding density that sub-region 632. Similarly, the winding density in region 620 can vary along its axial length.

Furthermore, while the foregoing examples feature coils with two regions of different winding density, more generally, coils can feature more than two regions. For example, coils can feature multiple regions of high winding density separated by regions of low winding density.

Figure 7:
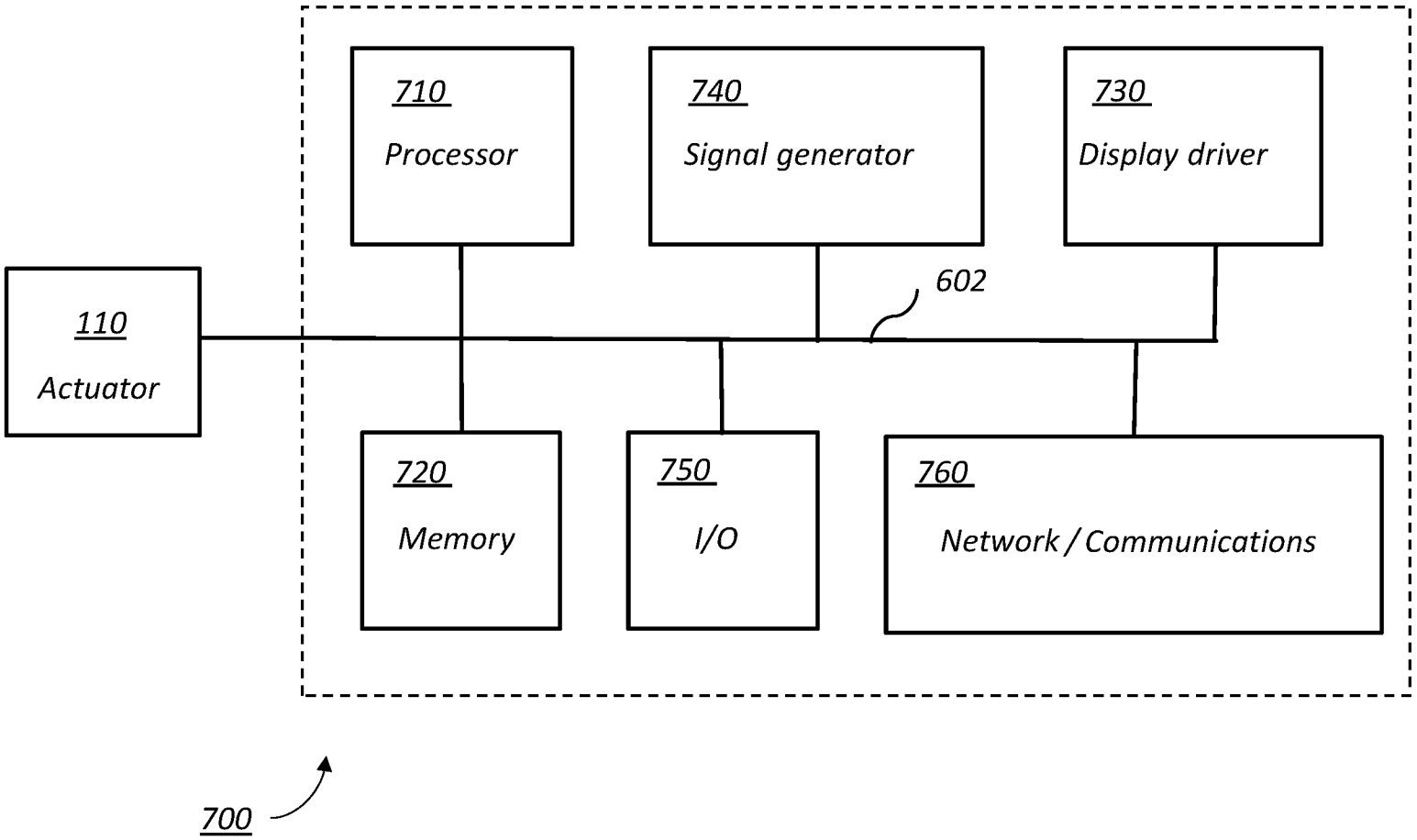
FIG. 7 is a schematic diagram of an embodiment of an electronic control module for providing drive signals to an actuator.

In general, electronic control modules are composed of one or more electronic components that receive input from one or more sensors and/or signal receivers of the mobile phone, process the input, and generate and deliver signal waveforms that cause actuator 510 to provide a suitable haptic response. Referring to FIG. 7, an exemplary electronic control module 700 of a mobile device, such as mobile phone 100, includes a processor 710, memory 720, a display driver 730, a signal generator 740, an input/output (I/O) module 750, and a network/communications module 760. These components are in electrical communication with one another (e.g., via a signal bus 702) and with actuator 110.

Processor 710 may be implemented as any electronic device capable of processing, receiving, or transmitting data or instructions. For example, processor 610 can be a microprocessor, a central processing unit (CPU), an application-specific integrated circuit (ASIC), a digital signal processor (DSP), or combinations of such devices.

Memory 720 has various instructions, computer programs or other data stored thereon. The instructions or computer programs may be configured to perform one or more of the operations or functions described with respect to the mobile device. For example, the instructions may be configured to control or coordinate the operation of the device's display via display driver 730, signal generator 740, one or more components of I/O module 750, one or more communication channels accessible via network/communications module 760, one or more sensors (e.g., biometric sensors, temperature sensors, accelerometers, optical sensors, barometric sensors, moisture sensors and so on), and/or actuator 110.

Signal generator 740 is configured to produce AC waveforms of varying amplitudes, frequency, and/or pulse profiles suitable for actuator 110 and producing acoustic and/or haptic responses via the actuator. Although depicted as a separate component, in some embodiments, signal generator 740 can be part of processor 710. In some embodiments, signal generator 740 can include an amplifier, e.g., as an integral or separate component thereof.

Memory 720 can store electronic data that can be used by the mobile device. For example, memory 720 can store electrical data or content such as, for example, audio and video files, documents and applications, device settings and user preferences, timing and control signals or data for the various modules, data structures or databases, and so on. Memory 720 may also store instructions for recreating the various types of waveforms that may be used by signal generator 740 to generate signals for actuator 110. Memory 720 may be any type of memory such as, for example, random access memory, read-only memory, Flash memory, removable memory, or other types of storage elements, or combinations of such devices.

As briefly discussed above, electronic control module 700 may include various input and output components represented in FIG. 7 as I/O module 750. Although the components of I/O module 750 are represented as a single item in FIG. 7, the mobile device may include a number of different input components, including buttons, microphones, switches, and dials for accepting user input. In some embodiments, the components of I/O module 750 may include one or more touch sensor and/or force sensors. For example, the mobile device's display may include one or more touch sensors and/or one or more force sensors that enable a user to provide input to the mobile device.

Each of the components of I/O module 750 may include specialized circuitry for generating signals or data. In some cases, the components may produce or provide feedback for application-specific input that corresponds to a prompt or user interface object presented on the display.

As noted above, network/communications module 760 includes one or more communication channels. These communication channels can include one or more wireless interfaces that provide communications between processor 710 and an external device or other electronic device. In general, the communication channels may be configured to transmit and receive data and/or signals that may be interpreted by instructions executed on processor 710. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 760 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the electronic device 700 to a mobile phone for output on that device and vice versa. Similarly, the network/communications module 760 may be configured to receive input provided on another device to control the mobile device. For example, an audible alert, visual notification, or haptic alert (or instructions therefore) may be transmitted from the external device to the mobile device for presentation.

While the panel audio loudspeaker described above is incorporated into a mobile phone, more generally, the actuator technology disclosed herein can be used in other panel audio systems, e.g., designed to provide acoustic and/or haptic feedback. Generally, the panel may be a display system, for example based on OLED or LCD technology. The panel may be part of a smartphone, tablet computer, or wearable devices (e.g., smartwatch or head-mounted device, such as smart glasses).

Furthermore, while the examples describe above feature an inertial system in which the magnet assembly is suspended by spring elements from a rigid frame that is bonded to the panel, other arrangements are possible. For instance, the coils described herein can be used in actuators where the magnet assembly is mechanically grounded, e.g., by rigid attachment to the frame.

A number of embodiments are disclosed. Other embodiments are in the following claims.

What is claimed is:

1. A panel audio loudspeaker, comprising:

a display panel; and an actuator rigidly coupled to a surface of the display panel and configured to couple vibrations to the display panel to cause the display panel to vibrate, the actuator comprising:

a magnet assembly, the magnet assembly comprising a permanent magnet arranged within a cup, wherein an air gap exists between sidewalls of the cup and the permanent magnet; and a coil rigidly coupled to the display panel, the coil comprising a length of an electrically conducing wire wound in a coil and extending along an axis defining an axial direction, the coil comprising a first region having a first winding density and a second region having a second winding density higher than the first winding density, the second region at least partially extending into the air gap of the magnet assembly, wherein a mass of the display panel and a mass of the coil in the second region form a coupled oscillator configured to provide a resonant mode at a frequency in a range from 5 kHz to 20 kHz.

2. The panel audio loudspeaker of claim 1, wherein the first region extends in the axial direction from a first end of the coil that is coupled to the display panel to the magnet assembly.

3. The panel audio loudspeaker of claim 2, wherein the second region extends in the axial direction in the air gap to a second end of the coil opposite the first end of the coil.

4. The panel audio loudspeaker of claim 1, wherein the first region has a winding density lower compared to an average winding density of the coil and the second region has winding density higher than the average winding density.

5. The panel audio loudspeaker of claim 1, wherein the first region has a minimum winding density that is 75% of or less than an average winding density of the coil.

6. The panel audio loudspeaker of claim 1, wherein the second region has a maximum winding density that is 125% of or more than an average winding density of the coil.

7. The panel audio loudspeaker of claim 1, wherein a winding density of the coil in the first region is substantially constant along the axial direction.

8. The panel audio loudspeaker of claim 1, wherein a winding density of the coil in the first region varies along the axial direction.

9. The panel audio loudspeaker of claim 1, wherein a winding density of the coil in the second region is substantially constant along the axial direction.

10. The panel audio loudspeaker of claim 1, wherein a winding density of the coil in the second region varies along the axial direction.

11. The panel audio loudspeaker of claim 1, wherein the coil has a greater mechanical compliance in the first region than the second region.

12. The panel audio loudspeaker of claim 1, wherein the mass of the display panel and the mass of the coil in the second region form a coupled oscillator configured to provide a resonant mode at a frequency in a range from 8 kHz to 20 kHz.

13. The panel audio loudspeaker of claim 12, wherein the mass of the display panel and the mass of the coil in the second region form a coupled oscillator configured to provide a resonant mode at a frequency in a range from 8 kHz to 10 kHz.

14. The panel audio loudspeaker of claim 12, wherein the mass of the display panel and the mass of the coil in the second region form a coupled oscillator configured to provide a resonant mode at a frequency in a range from 10 kHz to 12 kHz.

15. The panel audio loudspeaker of claim 12, wherein the mass of the display panel and the mass of the coil in the second region form a coupled oscillator configured to provide a resonant mode at a frequency in a range from 12 kHz to 15 kHz.

16. The panel audio loudspeaker of claim 12, wherein the mass of the display panel and the mass of the coil in the second region form a coupled oscillator configured to provide a resonant mode at a frequency in a range from 15 kHz to 20 kHz.

17. The panel audio loudspeaker of claim 1, further comprising a cap extending along the coil adjacent to the first region of the coil, the cap being bonded to a same surface as an end of the coil.

18. The panel audio loudspeaker of claim 17, wherein the cap is a kapton or aluminum cap.

19. The panel audio loudspeaker of claim 17, wherein a radial thickness of the cap and the first region of the coil is the same as or less than a radial thickness of the second region of the coil.

20. The panel audio loudspeaker of claim 19, wherein the cap is positioned at an outer circumference of the coil.

21. The panel audio loudspeaker of claim 1, wherein the magnet assembly is suspended from the display panel by one or more compliant members.

22. The panel audio loudspeaker of claim 1, wherein the magnet assembly comprises a pole piece, the permanent magnet being positioned in the axial direction between the pole piece and a back plate of the cup, the air gap extending adjacent the pole piece.

23. The panel audio loudspeaker of claim 22, wherein the second region is adjacent the pole piece in the axial direction.

24. The panel audio loudspeaker of claim 22, wherein the pole piece comprises a soft magnetic material.

25. The panel audio loudspeaker of claim 1, wherein the sidewalls of the cup comprise a portion comprising a permanent magnet material and a portion comprising a soft magnetic material.

26. The panel audio loudspeaker of claim 1, further comprising a plate between the coil and the display panel, the plate being bonded on one side to the display panel and on an opposite side to the coil.

27. A mobile device or a wearable device, comprising:

a housing;

a display panel mounted in the housing;

an actuator coupling plate attached to the display panel;

a coil attached to the actuator coupling plate, the coil defining an axial direction and having a first region and a second region, the first region having a lower density of windings compared to the second region;

a magnet assembly comprising an inner portion and an outer portion separated from the inner portion by an air gap, the inner portion comprising permanent magnet extending within the magnet assembly along the axial direction, wherein the coil is arranged so that the second region is in the air gap; and an electronic control module electrically coupled to the coil and programmed to energize the coil to cause axial motion of the magnet assembly relative to the coil such that the display panel vibrates at frequencies and amplitudes sufficient to produce an audio response from the display panel, wherein a mass of the display panel and a mass of the coil in the second region form a coupled oscillator configured to provide a resonant mode at a frequency in a range from 5 kHz to 20 kHz.

* * * * *